US011518651B2

(12) United States Patent
Garbers et al.

(10) Patent No.: US 11,518,651 B2
(45) Date of Patent: Dec. 6, 2022

(54) ADDITIONAL PLATFORM FOR A WORKING PLATFORM

(71) Applicant: Inventio AG, Hergiswil (CH)

(72) Inventors: Olaf Garbers, Ettiswil (CH); Philip Hofer, Shanghai (CN); Frankie Schmid, Ebikon (CH)

(73) Assignee: INVENTIO AG, Hergiswil NW (CH)

( * ) Notice: Subject to any disclaimer, the term of this patent is extended or adjusted under 35 U.S.C. 154(b) by 434 days.

(21) Appl. No.: 16/610,117

(22) PCT Filed: May 28, 2018

(86) PCT No.: PCT/EP2018/063899
§ 371 (c)(1),
(2) Date: Nov. 1, 2019

(87) PCT Pub. No.: WO2018/219851
PCT Pub. Date: Dec. 6, 2018

(65) Prior Publication Data

US 2020/0079620 A1 Mar. 12, 2020

(30) Foreign Application Priority Data

Jun. 2, 2017 (EP) ..... 17174315

(51) Int. Cl.
*B66B 5/00* (2006.01)
*B66B 11/02* (2006.01)
(Continued)

(52) U.S. Cl.
CPC ..... *B66B 5/0081* (2013.01); *B66B 5/0087* (2013.01); *B66B 11/0246* (2013.01); *B66B 19/00* (2013.01); *E04G 1/367* (2013.01)

(58) Field of Classification Search
CPC ..... B66B 5/005; B66B 5/0081; B66B 5/0087; B66B 11/0246; B66B 19/00; E04G 1/367;
(Continued)

(56) References Cited

U.S. PATENT DOCUMENTS 3,232,377 A * 2/1966 Smith ..... E04G 1/18 182/115
5,411,112 A * 5/1995 Jephcott ..... E06C 1/39 182/36
(Continued)

FOREIGN PATENT DOCUMENTS

CN 1675121 A 9/2005
CN 1751164 A 3/2006
(Continued)

*Primary Examiner* — Michael A Riegelman
(74) *Attorney, Agent, or Firm* — William J. Clemens; Shumaker, Loop & Kendrick, LLP

(57) ABSTRACT

A working device for carrying out fitting or maintenance work in an elevator shaft includes at least one working platform having a standing surface and a railing. The standing surface affords space for at least one person and the railing at least partially encloses the standing surface. The working device also includes at least one additional platform that is attachable to the railing of the working platform, and wherein the additional platform affords an additional standing surface for at least one person. The additional standing surface is arranged above the railing of the working platform.

16 Claims, 5 Drawing Sheets

(51) Int. Cl.
*B66B 19/00* (2006.01)
*E04G 1/36* (2006.01)

(58) Field of Classification Search
CPC ..... E04G 1/36; E04G 1/365; E04G 5/062; E04G 21/3223; E06C 1/39; E06C 7/181; E06C 7/182; E06C 7/185
See application file for complete search history.

(56) References Cited

U.S. PATENT DOCUMENTS 6,533,069 B1 * 3/2003 Couillard ..... E06C 7/48 182/83
8,646,224 B2 * 2/2014 Wurth ..... E04G 21/14 182/128
11,203,872 B2 * 12/2021 Hilgendorf ..... E04F 11/062
2001/0022253 A1 * 9/2001 Reuter ..... B66B 11/002 187/254
2003/0136611 A1 * 7/2003 Erny ..... B66B 19/00 187/401
2005/0139421 A1 * 6/2005 Stingl ..... E04G 1/367 182/82
2007/0271863 A1 * 11/2007 Lindh ..... B66B 9/187 52/239
2013/0186710 A1 * 7/2013 Moss ..... E06C 7/185 182/104
2015/0166198 A1 * 6/2015 Hokanson ..... E06C 1/12 182/101
2015/0181860 A1 * 7/2015 Johnson ..... A01M 31/02 182/187
2016/0130115 A1 * 5/2016 Blaska ..... B66B 5/0087 187/401
2016/0332845 A1 * 11/2016 Kere ..... E04G 3/28
2018/0282119 A1 * 10/2018 Lindberg ..... B66B 5/0081
2019/0078385 A1 * 3/2019 Moss ..... E06C 1/397
2019/0194957 A1 * 6/2019 Wurth ..... E04G 1/367
2019/0226217 A1 * 7/2019 Foley ..... E04G 1/30
2019/0330024 A1 * 10/2019 Durand ..... B66B 11/0226
2020/0079620 A1 * 3/2020 Garbers ..... B66B 5/0087
2020/0232235 A1 * 7/2020 Garbers ..... B66B 19/002
2020/0277164 A1 * 9/2020 Fauconnet ..... B66B 19/00
2021/0002104 A1 * 1/2021 Fauconnet ..... B66B 5/0087

FOREIGN PATENT DOCUMENTS

CN 1936251 A 3/2007
CN 100336713 C 9/2007
CN 202897969 U 4/2013
CN 202968039 U 6/2013
CN 203729604 U 7/2014
CN 204626921 U 9/2015
CN 106044656 A 10/2016
CN 110185380 A * 8/2019
EP 1270489 A1 1/2003
EP 1270489 A1 * 1/2003 ..... B66B 19/00
EP 1531210 A1 * 5/2005 ..... E04G 1/36
EP 1647512 A1 4/2006
EP 1527242 B1 4/2014
FR 2641018 A1 * 12/1988
GB 2452269 A 3/2009
JP H03120183 A 5/1991
JP H0829905 B2 3/1996
JP 09194160 A * 7/1997
JP 2888394 B2 5/1999
WO 2015126863 A2 8/2015
WO WO-2020216983 A1 * 10/2020

* cited by examiner

ADDITIONAL PLATFORM FOR A WORKING PLATFORM

FIELD

The present invention relates to a working device for carrying out installation or maintenance work in an elevator shaft.

BACKGROUND

Installation platforms are already used today for the installation of elevator equipment in an elevator shaft. Specifically, to enable working in an upper region of an elevator shaft, multi-level installation platforms are known. Thus, EP 1647512 A1 proposes installing an installation platform comprising an upper and a lower platform. This allows work to be carried out in a higher shaft region or on the shaft ceiling by climbing the upper platform.

Such an installation platform is difficult and complex to install.

GB 2 452 269 A discloses a lightweight installation platform which is intended to be installed in a fixed position in the shaft, is extended upwards and has at least one ladder or a further platform.

SUMMARY

The present invention is intended to provide an alternative means for carrying out work in a higher shaft region of an elevator shaft.

According to a proposed solution, the working device is designed to make it possible to carry out installation or maintenance work in an elevator shaft. To do this, the working device consists of at least one working platform comprising a standing surface and a railing, the standing surface providing space for at least one person and the railing surrounding the standing surface at least in part. Furthermore, the working device comprises at least one additional platform. This additional platform is designed such that it can be attached to the railing of the working platform and the additional platform provides an additional standing surface for at least one person, the additional standing surface being above the railing in the installed state, i.e. when it is attached to the railing.

It is advantageous here that the installation platform, which is designed for working in the region of a shaft access point preferably in the region of a top shaft access point, is easily expandable to allow work in a higher shaft region.

In a variant, the additional standing surface of the additional platform is above the railing and, when viewed from the standing surface of the working platform, is arranged outside the railing at least in part, but advantageously substantially or even entirely.

It is advantageous that the actual standing surface of the working platform can be kept fairly small. It is tailored to a width of a shaft opening, for example. As a result, however, distances to side walls are created to the sides of the working platform. The fact that the additional standing surface of the additional platform can be arranged outside the railing at least in part, or outside the standing surface of the working platform, the distance to side walls can be reduced, meaning that safe working is also possible in the regions of the shaft walls.

In an advantageous solution, a position of the additional standing surface of the additional platform can be shifted relative to the working platform. As a result, it is possible to respond flexibly to the respective dimensions of the elevator shaft.

In a variant, the additional platform has a barrier, which substantially encloses the additional standing surface and serves as fall protection.

It is advantageous that a worker who enters the additional platform is protected such that he cannot fall into the elevator shaft. This enables safe working.

In a variant, the barrier has an access gate, which is advantageously self-closing.

It is advantageous that a worker who is on the additional platform is protected all around such that he also cannot fall towards the access. In a configuration having a self-closing access gate, which thus needs to be deliberately opened in order to enter and exit, for example, by raising a railing bar and which closes again automatically after being deliberately opened, working safety is particularly high, since a person cannot forget to close the gate after entering the additional platform.

In a variant, the additional platform has climbing access, preferably a ladder, which is assembled with the additional platform. The ladder allows access to the additional standing surface from the working platform.

It is advantageous here that no separate ladder or the like is required to reach the additional platform. The climbing access does not have to be sought out, but it is integrated into the additional platform by necessity. This eliminates the need for improvisation and further reduces the risk of accidents.

In a variant, the additional platform can be suspended on the railing of the working platform. "Suspended" in this case is understood to mean that the additional platform is held on the railing, but loading forces, in particular vertical loading forces, can be introduced into the railing or, for example, can be introduced directly into the working platform. The additional platform can also be placed onto the railing of the working platform in this respect.

It is advantageous here that the additional platform can be attached as required. It therefore does not have to be permanently installed, but it can be suspended or even placed on the railing in desired working positions as required. Therefore, the additional platform does not hinder other applications of the working platform.

In a variant, the additional platform can be locked to the railing of the working platform by means of a lock after being suspended. Advantageously, the lock contains a self-closing latch which automatically locks the additional platform after being suspended on the railing. Alternatively or additionally, the locking takes place by means of a securing pin, a latching pin or the like. Preferably, the lock includes a clearly visible feature which displays the locking state (locked or unlocked).

It is advantageous here that the additional platform cannot be accidentally detached. This also increases the safety of use of the additional platform.

In a variant, the additional platform is movable on the railing. In this embodiment, movement can take place without the additional platform having to be detached. In this case, for example, by releasing the lock, a sideways movement of the additional platform is made possible.

It is overall advantageous that the additional platform can easily be moved rapidly at least along a straight railing piece. As a result, for example, an attachment or adjustment can be made in a rear region of the elevator shaft and then the additional platform can be moved forward such that work can be carried out in the region of a front side wall of the elevator shaft. The movability allows the additional platform to be arranged in desired working positions.

In a variant, the additional platform comprises a support which is fastened to the additional standing surface, preferably to an outer region of the additional standing surface, and which supports the additional standing surface on the working platform.

By means of a support of this kind, a load on the railing can primarily be reduced, and this allows for a simpler design of the railing itself. This is of course cost-effective and makes it easier to install the railing itself. Preferably, the support is pre-installed on the additional platform, for example, such that it can be pivoted or moved into a support position.

In a variant, the working device comprises two additional platforms, the two additional platforms being attachable or attached on opposite sides of the working platform. Preferably, the additional platforms are identical, i.e. they can essentially be mounted anywhere on the railing.

It is advantageous here that, for example, two people can work simultaneously on opposite sides of the elevator shaft, can work simultaneously or can install a component in the elevator shaft together.

In a variant, the working platform of the working device is a preferably temporary installation platform, which is arranged to carry out installation work in the elevator shaft, preferably in the region of an uppermost shaft opening.

The additional platform is arranged on the railing of this working platform in order to carry out work in a top region of the elevator shaft. The working platform is designed, for example, as described in application WO 2018/219758 A1 by the same applicant and incorporated herein by reference. The content of WO 2018/219758 A1 should be read alongside this application.

The above-identified application relates to a temporary installation platform in the form of a working platform for installing elevator equipment in an elevator shaft, to a method for installing such an installation platform, and to a method for adjusting such an installation platform. The proposed installation platform is in particular designed to be arranged substantially in the region of a shaft opening, such that the installation platform rests on a building-side floor surface in part and protrudes into the elevator shaft in part. The installation platform comprises a base frame and base panels which are placed onto the base frame or inserted into said frame. Furthermore, the base frame includes two lateral base beams, at least one front and one rear cross member interconnecting the two lateral base beams, and also at least two intermediate beams arranged in parallel with the two lateral base beams. The two intermediate supports are substantially supported by the front and the rear cross members.

This temporary installation platform is designed to interact in particular with a mounting beam, which mounting beam is suitable for attaching elevator loads or installation devices. In addition, guide rails can be arranged in an elevator shaft, which are intended to be used subsequently for guiding an elevator car and a counterweight. In many cases, tools such as an installation kit, for example, are installed in the region of the shaft ceiling, which allows such guide rails to be precisely arranged. The additional platform can now be advantageously used for arranging such a tool. Using this tool, guide lines or plumb lines can be positioned and aligned. The additional platform allows an installation team to safely reach the required fastening and adjustment points and allows the members of the installation team to move around in a safe environment at all times.

However, such a working device can be used in many ways. It can be temporarily installed and used for repairs in the elevator shaft. In a corresponding embodiment of a railing of an elevator car, the additional platform can also be installed on a railing of the elevator car in order to carry out repairs or cleaning work in a top region of the shaft of the elevator system, for example.

DESCRIPTION OF THE DRAWINGS

In the following, the concepts of the invention will now be explained with reference to an example in conjunction with the drawings, in which.

Figure 1:
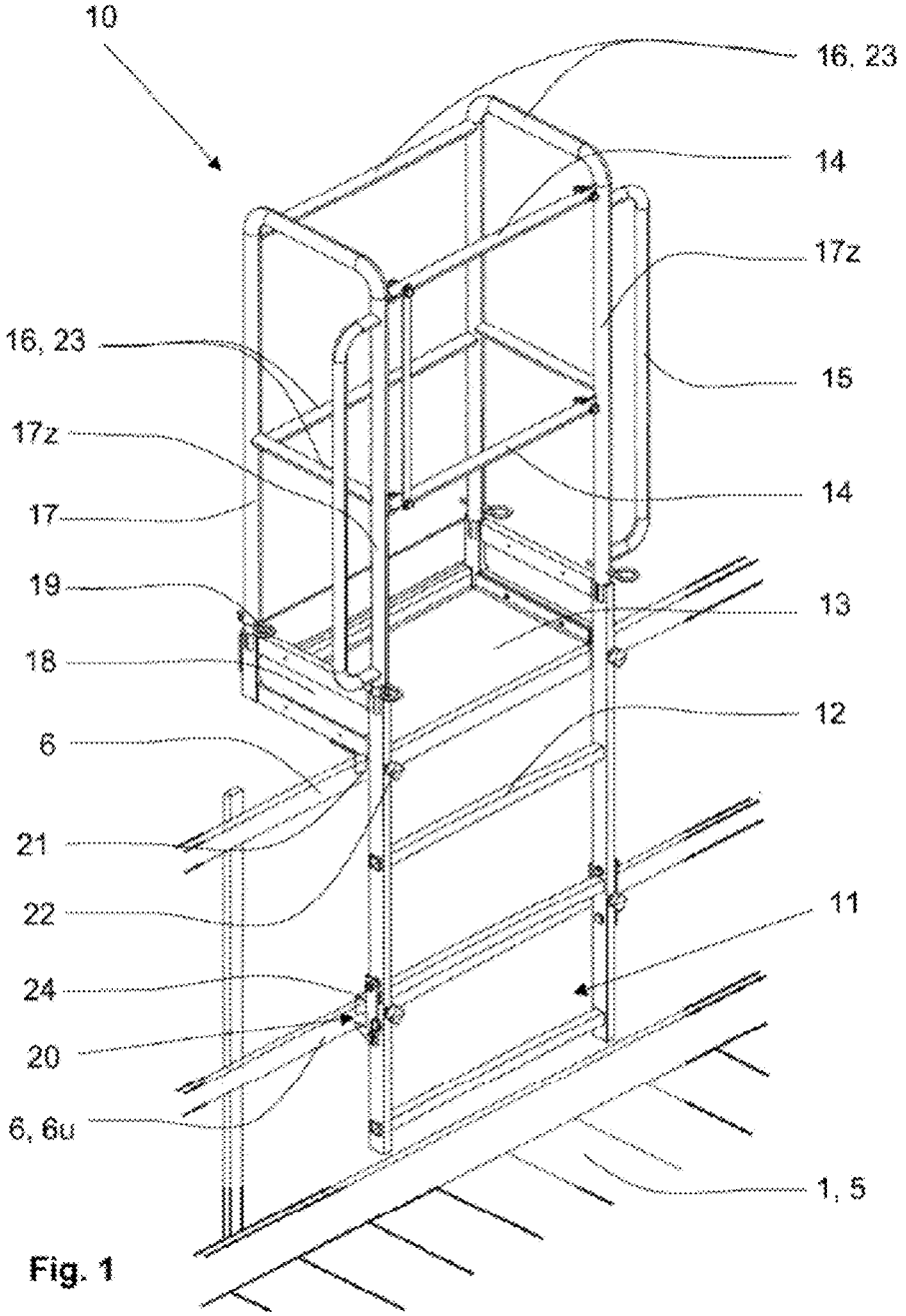
FIG. 1 is a view of an additional platform when attached to a working platform.

In the drawings, the same reference signs are used for equivalent parts in all of the drawings.

DETAILED DESCRIPTION

FIG. 1 shows an additional platform 10 for a working platform 1. The working platform 1, together with the additional platform 10, forms a working device for carrying out work in an elevator shaft. The standing surface 5 of the working platform 1 is dimensioned such that at least one person can stand and work on it. The working platform 1 may be an installation platform in an elevator shaft which is temporarily installed for the installation of shaft equipment, etc., for example, or it may also analogously be a roof structure of an elevator car (not shown), which has a standing surface 5 for carrying out inspection or servicing work in the elevator shaft. The working platform 1 is enclosed by a railing 6, **6*u* at least in part in order to provide the person working on the working platform with safety against falling. The working platform 1 comprising the standing surface 5 and the railing 6, 6*u* is shown schematically by dashed lines in FIG. 1**.

The additional platform 10 includes an additional standing surface 13, which is dimensioned such that a person can usually stand and work on it. The additional standing surface 13 is arranged above the railing 6 of the working platform 1.

In the embodiment, the additional standing surface 13 of the additional platform 10 is also designed such that, when viewed from above, it is arranged substantially outside the railing 6. It thus forms a working surface which projects laterally beyond the standing surface 5 of the working platform 1 and which is arranged above the railing 6. Depending on the requirements, the additional platform can also be configured (not shown) such that it is only arranged outside the railing in part and, when viewed from above, the other part thereof is arranged above the standing surface 5 of the working platform 1.

The additional standing surface 13 of the additional platform 10 has a barrier 16. The barrier 16 encloses the additional standing surface 13 on the three sides projecting from the working platform 1 and thus keeps a person working on the additional standing surface 13 safe from falling into an elevator shaft. The barrier 16 has a plurality of barrier posts 17, 17*z*, which in the example are mounted on holders on the additional standing surface 13 and are fixed there by means of a holding pin 19. Cross connections 23, which are mounted above the height of the barrier posts 17, 17*z*, complete the barrier 16. On the side of the additional standing surface 13 facing the working platform 1 is an access gate 14. This can be opened manually, such that a person can enter the additional standing surface 13. In the embodiment in FIG. 1, the additional standing surface 13 also has a foot protection strip 18. This also protects the person standing on the additional standing surface 13.

At the access gate 14, the additional platform 10 includes climbing access 11 in the form of a ladder 12. The climbing access 11 allows a person to climb up to the additional standing surface 13. In the example, the climbing access 11, or the ladder 12, is designed in an extension of the barrier posts 17*z* on the climbing-access side. In addition, a handrail 15 is arranged on the barrier posts 17*z* on the climbing-access side. The handrail 15 is primarily used to make it easier to climb up to the additional standing surface 13, but it can also be used to attach a safety rope, which additionally secures the person working on the working platform 1 or the additional platform 10.

Above the climbing access 11, the additional platform 10 can be suspended on the railing 6 of the working platform 1. For this purpose, an upper holder 21 which is used to suspend the additional platform 10 on the railing 6 is positioned in a region close to the additional standing surface 13 on the climbing access 11. The additional platform 10 can be secured by means of an upper safety device 22. The upper safety device 22 may be a clamping screw or may be a bolt that fits into an opening provided in the railing. In principle, the bolt can also penetrate below the railing and thus prevent the additional platform 10 from accidentally lifting off the railing 6.

Figure 3:
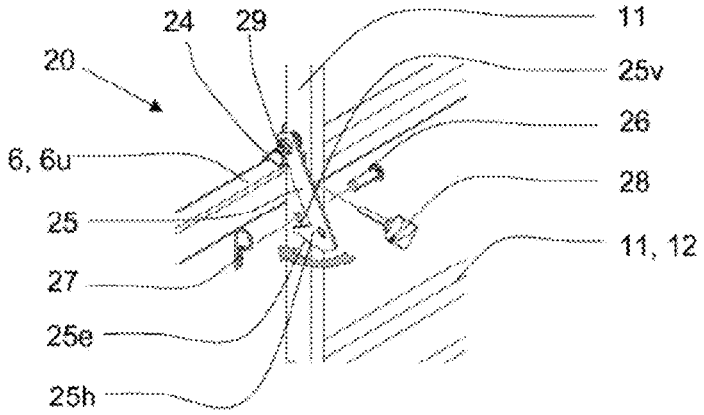
FIG. 3 is a view of a detail of a lock of the additional platform on the railing of the working platform.

Corresponding to a distance of a lower transverse strut 6*u* of the railing 6, a lower holder 24 is arranged on the climbing access 11, which, as explained in connection with the upper holder 21, is used to suspend the additional platform 10 on the railing 6. A lock 20 is also attached in the region of the lower holder 24. The lock 20 secures the additional platform 10 against accidentally becoming detached. In the example, the lock 20 is arranged in the region of the lower holder 24, but it could of course also be in the region of the upper holder 21. The lock 20 will be explained in greater detail with reference to FIG. 3.

The lock 20 comprises a latch 25 as a central element. The latch 25 is fastened to the climbing access 11, and or the ladder 12, by a pivot point 29. The latch 25 has a hook 25*h* at its lower end. Due to gravity, the latch 25 in principle hangs downwards and it is designed such that the hook 25*h* hangs below the lower transverse strut 6*u* of the railing 6. The hook 25*h* is beveled at one end surface 25*e* opposite a locking surface 25*v*, such that the latch 25 is pushed back when the additional platform 10 is placed on the railing 6, 6*u* and, after it has been placed thereon, which is determined by the lower holder 24, again falls into its position determined by gravity and thus the additional platform 10 is locked substantially automatically. The necessary locking can be reinforced as desired by a spring. In the example according to FIG. 3, the lock 20 can be additionally secured. For this purpose, a latching pin 26 is provided which is inserted through a structural part of the climbing access 11 and the latch 25 and is fixed by means of a latch-securing device 27. Furthermore, a separate additional safety device in the form of a lower safety device 28 is shown. The lower safety device 28 may be identical to the upper safety device 22, as previously described. The security measures shown can of course be used in combination or in isolation, as shown.

The additional platform 10 can be placed on the railing 6 in a desired working position. By loosening clamping screws or bolts, the additional platform can also be moved longitudinally on the railing. The longitudinal movement is simple, at least provided that no railing posts are present. In the regions of a railing post, it is at most required that the additional platform 10 is briefly lifted up.

Figure 2:
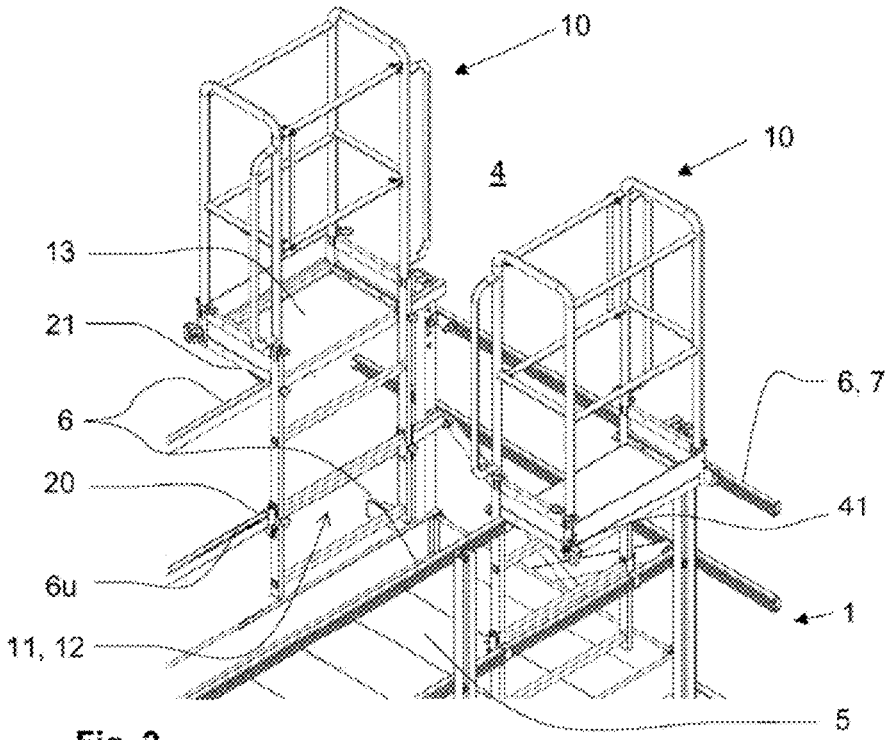
FIG. 2 is a view of a working device comprising a working platform and two additional platforms.

In FIG. 2, a working platform 1 is equipped with two additional platforms 10 and they together form a working device for carrying out installation or maintenance work in an elevator shaft 4. In the example, the additional platforms 10 are placed and secured on the respective railings 6 on both sides of the working platform 1, or on opposite sides of the working platform 1. The railing 6 usually also includes a rear railing 7. In addition, the rear railing 7 can serve as a base for arranging the additional platform 10 when designed accordingly.

Figure 4:
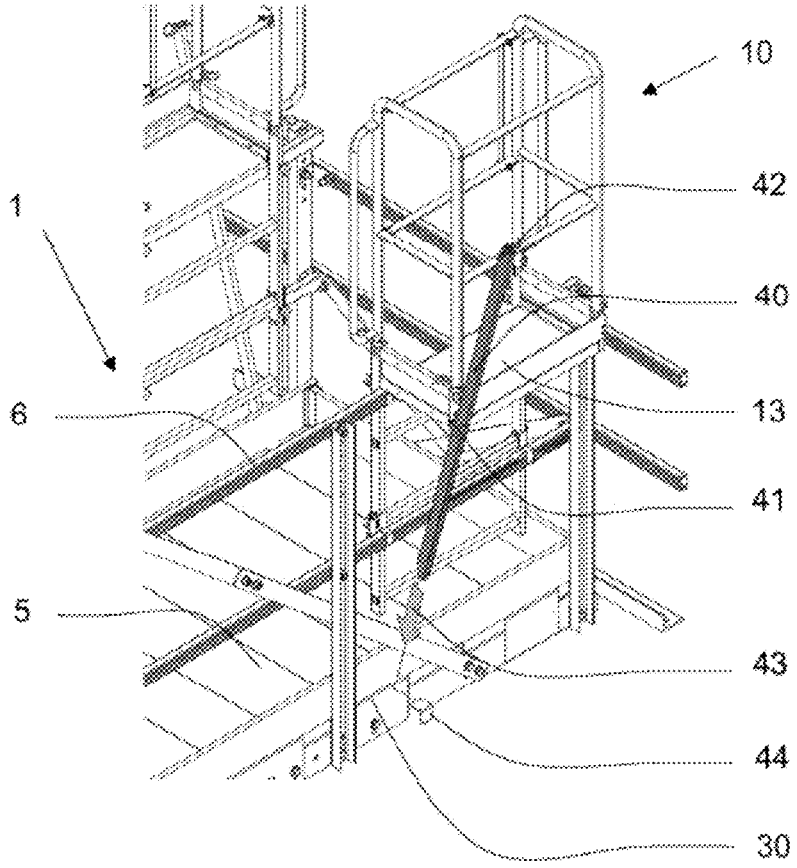
FIG. 4 shows an attachment of the additional platform on the working platform with the attachment of a support.

Depending on the size, design or load requirements on the additional platform 10, it is supported on the working platform 1 by means of a support 40 shown in FIG. 4. The support 40 is movably fastened to the outer region of the additional standing surface 13 by means of a support holder 41 (see also FIG. 2) and it can be fed downwards in the support holder 41 (arrow direction 43) until it is supported on the working platform 1 or on a support bracket 44 provided in the region of a base frame 30 of the working platform 1.

Of course, safety measures are also provided here, for example by means of a supporting safety device 42, which secures the support 40 against being accidentally released.

As required, it is of course possible to use a plurality of supports 40, for example at least two supports 40, at the two outer corner points of the additional standing surface 13.

Figure 5:
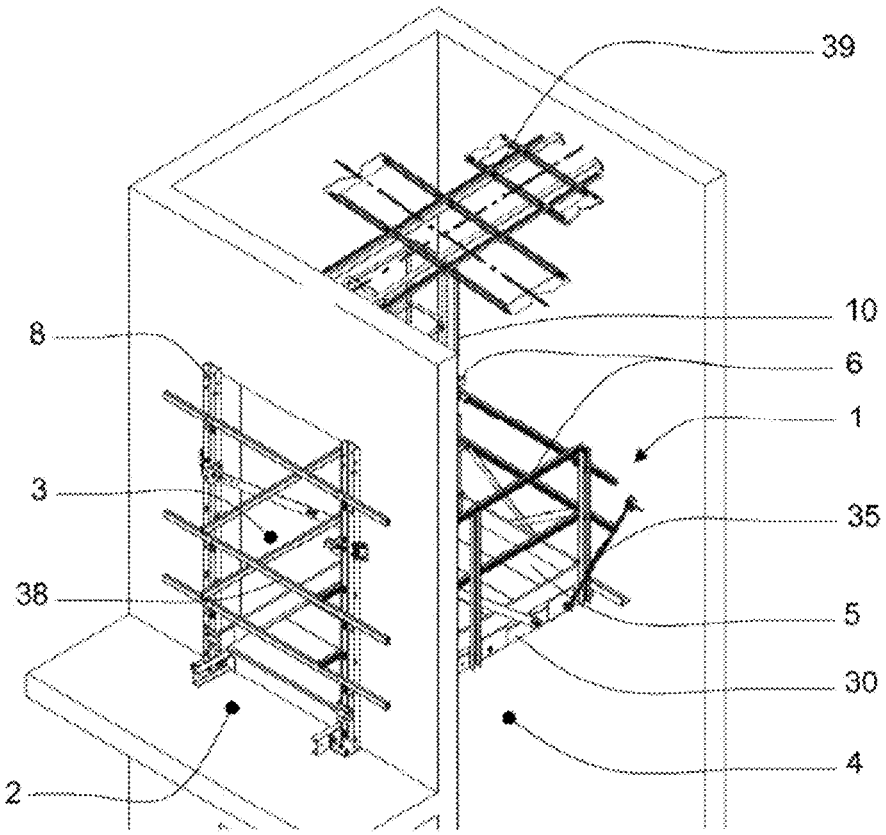
FIG. 5 shows the use of a working device comprising a working platform and additional platform for installation of an installation kit.

The working device formed by the working platform 1 and at least one additional platform 10 can now, as can be seen in FIG. 5, be used to carry out installation work in the elevator shaft. The device is arranged as a temporary installation platform or installation platform in the region of an uppermost shaft opening 3. The working platform 1 is fastened by means of posts 8 to the building structure and rests on the base frame 30 in part on a building-side floor surface 2. The working platform 1 is additionally held in the elevator shaft 4 by means of an additional cable safety device 35. The additional platform 10 is placed on the railing 6 of the working platform 1 and, as described in the preceding explanations, is fixed in position and secured. An installation kit 39 is arranged in the uppermost region of the elevator shaft 4. This exemplary installation kit is used as an assembling jig for aligning guide rails, shaft doors, and other components. This installation kit 39 can be fastened as high as possible in the elevator shaft by means of the additional platform 10. Only a single additional platform 10 is visible in FIG. 5. In practice, two additional platforms 10 could also be used in this application, as explained in connection with FIG. 2.

If one person is standing on each additional platform 10, the installation kit 39 can be raised together and fastened in the appropriate position in the elevator shaft. The working device consisting of the working platform 1 and at least one additional platform 10 is suitable for carrying out work easily and safely in a top region of the elevator shaft.

In the embodiment in FIG. 5, bars 38 are also attached to the posts 8. These prevent accidental entry to the working platform 1. If necessary, the bars 38 may be provided with warning signs that warn against entering the working platform. Locks could also be provided on the bars 38, which would allow them to be removed only with a corresponding key.

Figure 6:
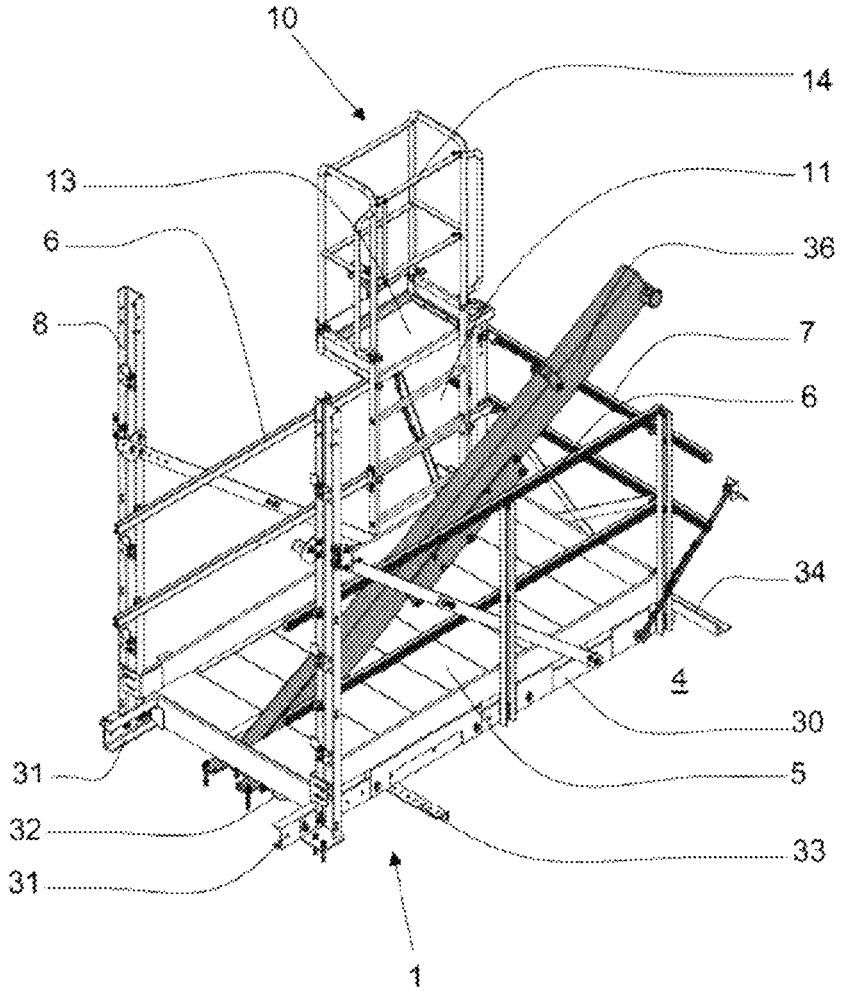
FIG. 6 shows a working device comprising a working platform and an additional platform together with a mounting beam.

FIG. 6 shows an alternative or additional application of the working device consisting of the working platform 1 and additional platform 10 in a different configuration. The working platform 1 itself is penetrated by a mounting beam 36 which is arranged in the elevator shaft 4. Nevertheless, the standing surface 5 remains on the working platform and the additional platform 10 can still be arranged laterally on the railing 6 of the working platform 1, which also allows for work in an upper shaft region. The additional platform 10 and its additional standing surface 13 is still accessible from the working platform via the climbing access 11. Of course, the railing of the working platform 1 also includes the rear railing 7. The rear railing 7 may be designed substantially identically to the side railing 6. In principle, the additional platform 10 can also be arranged on the rear railing 7.

The working platform 1 in turn comprises the base frame 30 and base panels that define the standing surface 5 of the working platform 1. The base panels are placed on the base frame 30 or inserted into said frame. Furthermore, the base frame 30 includes two lateral base beams 31, at least one front 33 and one rear 34 cross member interconnecting the two lateral base beams 31, and also at least two intermediate beams 32 arranged in parallel with the two lateral base beams 31. The two intermediate supports 32 are substantially supported by the front and the rear cross members 33, 34 and are spaced apart enough that the mounting beam 36 can be guided therebetween. Analogously to the embodiment in FIG. 5, the working platform is connected to the building-side structure by means of posts 8.

A person skilled in the art may extensively vary the arrangements shown. Therefore, instead of a working platform 1 which is inserted from the shaft opening 3 into the elevator shaft 4, any other form of working platform 1 may also be used. For example, the working platform 1 can be constructed and fastened in the elevator shaft 4 on walls by means of holding shoes or it may be a movable working platform 1. In the examples, the additional standing surface 13 of the additional platform 10 is in each case directly above the railing 6, substantially resting thereon. The additional standing surface 13 may also be arranged at a distance above the railing 6 when designed accordingly.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A working device for carrying out installation or maintenance work in an elevator shaft, the working device comprising:

a working platform having a standing surface and a railing, the standing surface providing space for at least one person to stand and the railing surrounding the standing surface at least in part, the standing surface and the railing being positioned within an elevator shaft when the working platform is installed in the elevator shaft;

an additional platform attached to the railing of the working platform, the additional platform having an additional standing surface for at least one person to stand, the additional standing surface being arranged above the railing; and wherein the additional standing surface, when viewed from the standing surface of the working platform, is arranged outside of the railing at least in part.

2. The working device according to claim 1 wherein the additional standing surface, when viewed from the standing surface of the working platform, is arranged outside of the railing.

3. The working device according to claim 1 wherein the additional platform has a barrier that substantially encloses the additional standing surface for protecting a person from falling from the additional platform.

4. The working device according to claim 3 wherein the barrier has an access gate for entering and exiting the additional standing surface.

5. The working device according to claim 1 wherein the additional platform has a climbing access to allow a person to access the additional standing surface from the working platform.

6. The working device according to claim 5 wherein the climbing access is a ladder.

7. The working device according to claim 1 wherein the additional platform is suspended on the railing of the working platform.

8. The working device according to claim 7 including a lock for locking the additional platform to the railing of the working platform after the additional platform is suspended on the railing.

9. The working device according to claim 8 wherein the lock includes a self-closing latch that automatically locks the additional platform to the railing after the additional platform is suspended on the railing.

10. The working device according to claim 1 wherein the additional platform is movable on the railing.

11. The working device according to claim 1 wherein the additional platform includes a support fastened to the additional standing surface and supporting the additional standing surface on the working platform.

12. The working device according to claim 11 wherein the support is fastened to the additional standing surface at an outer region of the additional standing surface.

13. The working device according to claim 1 including two of the additional platform, the two additional platforms being attached to the railing on opposite sides of the working platform.

14. The working device according to claim 1 wherein the working platform is a temporary installation platform arranged in a region of an uppermost shaft opening for carrying out installation work in the elevator shaft and the additional platform is arranged on the railing of the working platform to allow work in a top region of the elevator shaft.

15. A working device for carrying out installation or maintenance work in an elevator shaft, the working device comprising:

a working platform having a standing surface and a railing, the standing surface providing space for at least one person to stand and the railing surrounding the standing surface at least in part;

an additional platform attached to the railing of the working platform, the additional platform having an additional standing surface for at least one person to stand, the additional standing surface being arranged above the railing;

wherein the additional standing surface, when viewed from the standing surface of the working platform, is arranged outside of the railing at least in part;

wherein the additional platform is suspended on the railing of the working platform;

a lock for locking the additional platform to the railing of the working platform after the additional platform is suspended on the railing; and wherein the lock includes a self-closing latch that automatically locks the additional platform to the railing after the additional platform is suspended on the railing.

16. A working device for carrying out installation or maintenance work in an elevator shaft, the working device comprising:

a working platform having a standing surface and a railing, the standing surface providing space for at least one person to stand and the railing surrounding the standing surface at least in part;

an additional platform attached to the railing of the working platform, the additional platform having an additional standing surface for at least one person to stand, the additional standing surface being arranged above the railing;

wherein the additional standing surface, when viewed from the standing surface of the working platform, is arranged outside of the railing at least in part; and wherein the additional platform is movable sideways along the railing.

* * * * *